US006131364A

United States Patent [19]

Peterson

[11] Patent Number: 6,131,364

[45] Date of Patent: Oct. 17, 2000

[54] SPACER FOR INSULATED WINDOWS HAVING A LENGTHENED THERMAL PATH

[75] Inventor: Wallace H. Peterson, Everett, Wash.

[73] Assignee: Alumet Manufacturing, Inc., British Columbia, Canada

[21] Appl. No.: 09/222,065

[22] Filed: Dec. 29, 1998

Related U.S. Application Data

[63] Continuation-in-part of application No. 08/898,705, Jul. 22, 1997, abandoned.

[51] Int. Cl.[7] ..... E06B 3/24; E06B 3/663

[52] U.S. Cl. ..... 52/786.13; 52/172; 52/656.5; 52/656.7; 52/732.1; 52/734.2; 52/745.19

[58] Field of Search ..... 52/172, 656.5, 52/656.7, 732.1, 734.2, 745.19, 786.13

[56] References Cited

U.S. PATENT DOCUMENTS 4,057,945 11/1977 Kessler .
5,377,473 1/1995 Narayan et al. .
5,439,716 8/1995 Larsen .
5,568,714 10/1996 Peterson .

FOREIGN PATENT DOCUMENTS 628314 11/1961 Italy .

*Primary Examiner*—Christopher T. Kent
*Attorney, Agent, or Firm*—Todd N. Hathaway

[57] ABSTRACT

An elongate tubular spacer frame bar for insulating windows. The spacer frame bar is formed of metal and has spaced, staggered sequences of longitudinally oriented elongate slits which increase the length of the thermal conductivity path from the first pane to the second. These slits are formed by displacing the material so that this breaks and shears away along the edges of the slit, thereby forming an effective but narrow air gap. The air gap is sized to prevent the escape particulate desiccant material from within the interior of the spacer.

20 Claims, 3 Drawing Sheets

SPACER FOR INSULATED WINDOWS HAVING A LENGTHENED THERMAL PATH

CONTINUING INFORMATION

This is a continuation-in-part application of U.S. patent application Ser. No. 08/898,705, entitled "Spacer for Insulated Windows having a Lengthened Thermal Path", filed Jul. 22, 1997 now abandoned.

FIELD OF THE INVENTION

The present invention relates to spacer frame bars used to maintain a separation between glass panes in insulated glass panels and, in particular, to spacer frame bars having a lengthened thermal path.

BACKGROUND OF THE INVENTION

It is well known in the art to provide a window with more than one pane of glass separated by an airspace. Such windows are known as insulating windows or insulated glass panels by virtue of the fact that the air or other gaseous material (argon, helium, nitrogen, etc.) trapped within the space between the glass panes serves as an insulator to reduce heat flow through the glass.

Typically, the glass panes are separated by a spacer frame formed from sections of tubing joined together at adjacent ends to form a continuous frame. The spacer frame lies between the glass panes and extends around their perimeter. The tubes comprising the spacer frame, also known as spacer frame bars, are commonly made of metal, such as aluminum alloy or steel or stainless steel: in addition to being commercially economical, these materials are sufficiently strong and rigid to permit the tubes to function as spacer frame bars. Also, aluminum and steel exhibit good corrosion resistance, and their structural integrity is not adversely affected by long-term exposure to sunlight.

The use, however, of an aluminum or metal spacer frame is not without its problems. A significant heat transfer problem may arise because an aluminum or metal spacer is a much better heat conductor than the surrounding airspace. Because the spacer and glass panes are contiguous, the spacer itself acts as a conduit for energy transfer between inside and outside panes of glass. Thus, significant energy loss may result because of the spacer's physical contact with the glass panes.

One partial solution to heat transfer through the spacer is provided by U.S. Pat. No. 5,568,714 to Peterson. The invention of Peterson provides an elongate tubular spacer with an integral thermal break that reduces energy flow between glass panes. Although the thermal break impedes heat transfer through the spacer, heat transfer impedance can still be an issue because the metal on either side of the thermal break still rapidly conducts thermal energy.

Another partial solution is provided by U.S. Pat. No. 5,377,473 to Narayan et al. The invention of Narayan provides a spacer having a lower web which is generally W-shaped in cross-section to provide a lengthened thermal path, and an upper web which is pierced by a series of staggered slots. The slots eliminate any straight-line thermal path across the upper web, thereby increasing the effective length of the thermal path, and also allow fluid contact between the air/gas in the interpane space and a desiccant material which is encased within the spacer. Unfortunately, the slots in the invention of Narayan et al. also allow the desiccant material (typically, a silica gel or other material which is in a granular or powder form so as to maximize surface area) to escape from the interior of the spacer into the interpane space, especially along the sides and top of the window. Once the desiccant material escapes into the interpane space it tends to collect on the inside surfaces of the glass panes, where it is impossible to remove, thereby giving the window a permanently cloudy or dusty appearance.

Accordingly, there exists a need for an improved metal spacer bar which defines elongate thermal paths between glass panes for enhancing thermal efficiency of insulated windows or other panels. Furthermore, there exists a need for such a spacer bar which establishes fluid contact between the air or other gasses in the interpane space and a desiccant material which is encased within the spacer bar, but without possibility of the desiccant escaping from the spacer bar into the space between the panes.

SUMMARY OF THE INVENTION

The present invention provides a tubular spacer frame bar defining an elongate thermal path for reducing energy flow between glass panes in insulated glass panels. The spacer frame bar has elongate first and second sidewalls held in spaced parallel disposition by an upper and lower wall spanning therebetween. The first and second sidewalls contact the first and second glass panes along first and second contact lines with either pane of glass. Heat transfer through the spacer frame bar is impeded by corrugating at least one side of the spacer frame, thereby lengthening the thermal migration distance between nth glass panes.

In a further aspect of the invention, the spacer frame bar defines multiple slits that are longitudinally staggered on the upper wall thereof such that the transfer of heat energy is further impeded through the spacer frame bar.

In a preferred embodiment of the invention, the first and second sidewalls are corrugated to form multiple elongate folds. The folds extend the thermal migration distance between the first and second glass panes through the spacer frame bar by increasing the path through which heat energy must travel. Thus, the slits and folds in the sidewalls, whether separately or in combination with each other, effectively increase the thermal migration path between the glass panes, and therefore, dissipate thermal energy before it is transmitted through the cooler window pane.

BRIEF DESCRIPTION OF THE DRAWINGS

The foregoing aspects and many of the attendant advantages of this invention will become better understood by reference to the following detailed description, when taken in conjunction with the accompanying drawings, wherein.

DETAILED DESCRIPTION

Figure 1:
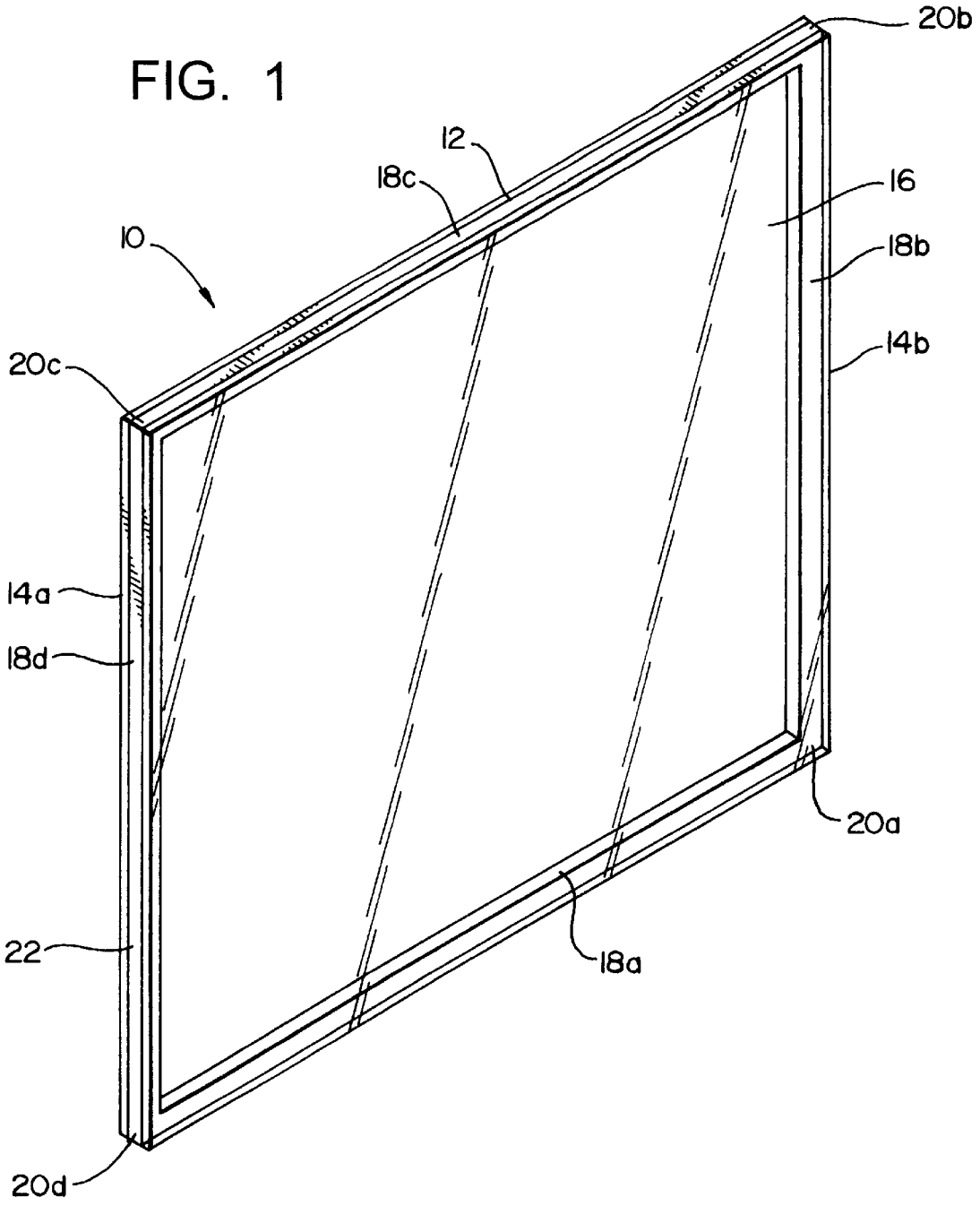
FIG. 1 is a perspective view of one embodiment of an insulated glass panel constructed according to the invention.

An insulated glass panel 10 made in accordance with the present invention is illustrated in FIG. 1. The insulated glass panel 10 includes an essentially rectangular spacer frame 12 sandwiched between first and second panes of glass 14*a,* 14*b,* thereby defining a hermetic airspace 16 within the space bounded by the glass panes 14*a,* 14*b* and the frame 12. The frame 12 extends completely around the outer periphery of the insulated glass panel 10 adjacent the peripheral edges of the glass panes 14. The frame 12 is formed by segments of spacer frame bars 18*a,* 18*b,* 18*d,* each forming one side of the spacer frame 12. The spacer frame bars are joined at their ends by corner connectors, as is known in the art, to define spacer frame corners 20*a,* 20*b,* 20*c,* 20*d.*

For ease of understanding, the terms "upward", "upper", "top" and so on will refer in this description and the appended claims to that side of the spacer which faces towards the interpane space (i.e., towards the space between the two panes); conversely, the terms "downward", "lower", "bottom" and the like will refer to the side of the spacer which faces in the opposite direction (i.e., the direction outwardly from the interpane space), and the terms "side", "lateral", and the like will refer to the sides of the spacer which engage the panes. It will be understood, of course, that the actual physical orientation of the spacer will depend on its actual location or installation within the panel (e.g., whether the spacer is mounted along the top or bottom edges or sides, of the assembly).

Figure 2:
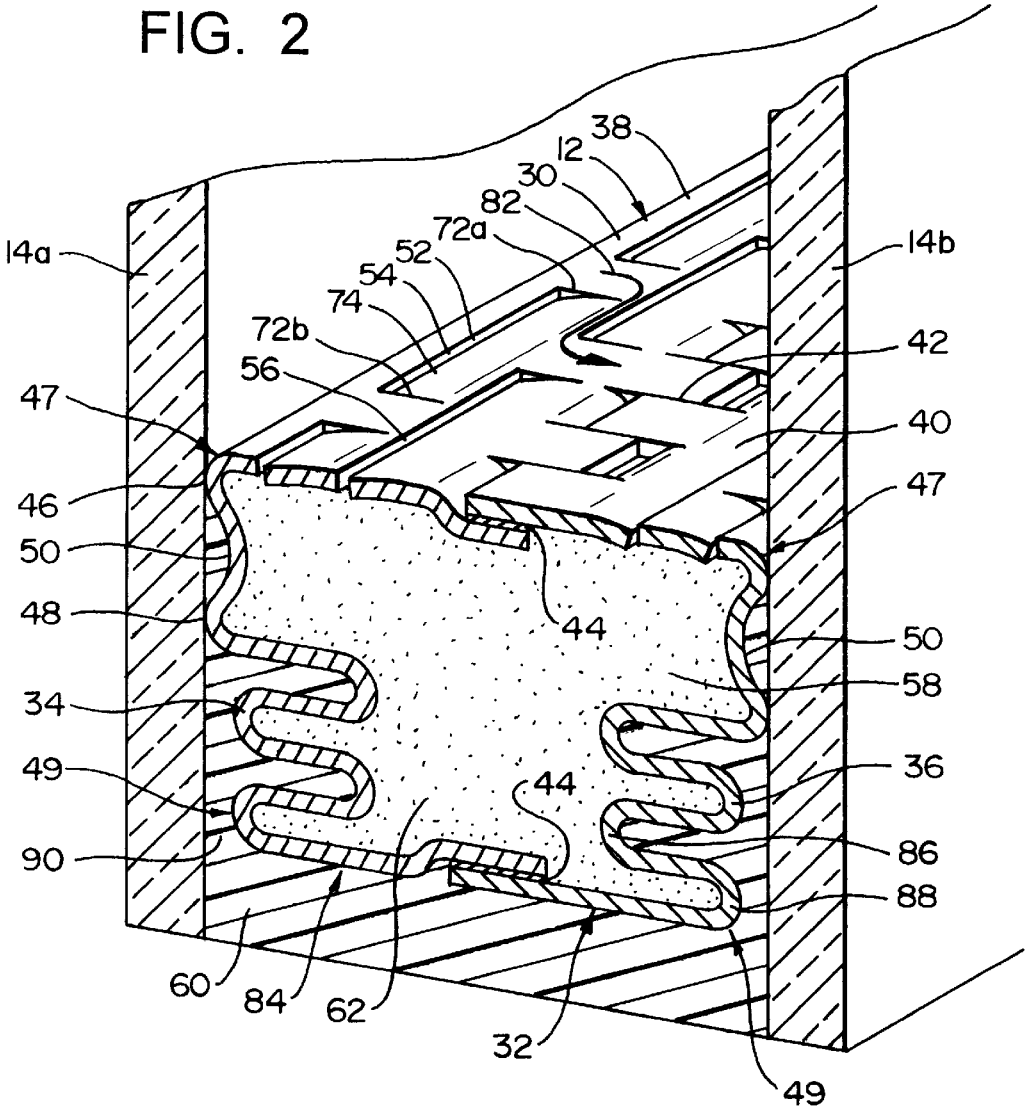
FIG. 2 is a cross-sectional view of an insulated glass panel showing the first preferred embodiment of a spacer frame bar positioned between two glass panes.

Attention is now directed to FIG. 2 for understanding a first preferred embodiment of the frame 12, The frame 12 defines elongate upper and lower surfaces 30 and 32, held in spaced parallel disposition by longitudinal first and second sidewalls 34 and 36. In the preferred embodiment, the frame 12 is formed by joining first and second halves 38 and 40 of the thin-walled elongate metal tube together, defining a substantially rectangular cross-section. Although a frame 12 constructed from two halves is the preferred embodiment, other constructions of the frame 12, such as a unibody construction, are also within the scope of the invention. The first and second halves 38 and 40 are preferably each roll formed from a continuous piece of high-strength material, such as stainless or galvanized steel. However, other materials, such as aluminum or glass, are within the scope of the invention.

Each half 38, 40 has a general "C" shaped cross-sectional profile. The longitudinal edges of the halves 38, 40 are periodically and transversely slit to define a plurality of short transverse tabs which are alternately crimped. The longitudinal edges of the two halves 38, 40 are interleaved, with the crimped tab of one half underlying the crimped tab of another half, in alternating fashion. An interleaved elongate first seam 42 is thus defined along the upper surface 30 by the overlapping intersection of the first and second halves 38 and 40 when the two halves are joined together. Similarly, an interleaved elongate second seam (not shown) is defined along the lower surface 32. The elongate seams each include an elongate insulating member strip 44 between the interleaved tabs. The insulating member 44 is suitably manufactured from a nonmetallic, low heat-conductive material, such as rubber. The insulating members 44 are interwoven into the seams to define an integral thermal break therebetween, as disclosed in U.S. Pat. No. 5,568,714 issued to Peterson, the disclosure of which is hereby expressly incorporated.

The use of a frame 12, including integral low-conductivity thermal breaks is preferred. However, even alternate frame constructions that do not include thermal breaks would benefit from the thermal path lengthening slits and corrugations of the present invention, and thus, are within the scope of the present invention.

The first half 38 of the frame 12 contacts the first glass pane 14*a* along integrally molded elongate first and second contact lines 46 and 48 located on the first sidewall 34 such that the contact area between the frame 12 and the glass pane 14*a* is limited to the contact lines 46 and 48. The first contact line 46 is formed substantially near the upper arcuate corner 47 defined by intersection of the upper surface 30 and the sidewall 34. The second contact line 48 is spaced a predetermined distance below the first contact line 46, preferably formed substantially near the midpoint of the sidewall 34. The first and second contact lines 46 and 48 protrude from the sidewall 34 such that a curved recess 50 is defined therebetween. The second half 40 of the frame 12 is configured identically to the first half 38. While contact of the first and second halves 38, 40 with the glass panes along only contact lines 46, 48 is desired, it should be apparent that configuring two halves 38, 40 differently, such that a flat sidewall contacts the glass panes, is also within the scope of the present invention.

The upper surface 30 of the first and second halves 38 and 40 includes a plurality of elongate slits 52 extending vertically therethrough. In the preferred embodiment, the slits 52 are arranged in first and second rows 54 and 56 oriented in the longitudinal direction of the upper surface 30 of each half 38 and 40. Thus, there are two sets of slits 52, each set including two rows 54 and 56 of slits. One set of rows 54, 56 is formed within the first half 38, while an identical set of rows, 54, 56 is formed in the second half 40. Referring initially to the first half 38 of the frame 12, the first and second rows of slits 54 and 56 are disposed parallel to each other between the first seam 42 and the upper corner 47 of the corresponding half 38, 40. The first row of slits 54 is located substantially one-third of the distance across the width of the upper surface 30, as measured from the seam 42. The second row of slits 56 is positioned on the upper surface 30 midway between the first row 54 and the seam 42. The slits 52 of the first row 54 are staggered relative to the slits 52 of the second row 56 such that the slits 52 defining the first row 54 alternate and overlap in spaced relationship the slits 52 defining the second row 56, thereby interrupting the flow of heat energy traversing the upper surface 30. Thermal energy passing from one glass pane to another must conduct through a tortured path extending through the staggered rows of slits 52. The thermal conductive path is thus significantly longer from one glass pane to the other glass pane than the width of the frame 12. The second half of the frame 40 is configured identically to the first half 38 previously described. Thus, the upper surface 30 of the second half 40 also defines first and second rows of slits 54 and 46 that interrupt the flow of heat energy thereacross.

The slits 52 also serve as ventilation apertures that establish fluid communication between the interpane airspace 16 and the chamber 58 defined within the interior of the tubular frame 12. Each frame 12 is filled with a particulate desiccant material 62 (e.g., silica gel), and this is effective to dehumidify air that is trapped in the airspace 16 during assembly of the insulated glass panel 10, so that the possibility of condensation of moisture from the air entrapped in the airspace is minimized. As is well known in the art, air is constantly circulated by changes in the barometric pressures. Changes in barometric pressure cause the glass panes 14*a* and 14*b* to act like diaphragms that pump air into and out of the airspace 16. The transfer of air also acts to equalize the temperature within the airspace 16, thereby assisting in minimizing the temperature differential therein.

In order to permit the air to thus pass in and out of chamber 58, but at the same time prevent any escape of the desiccant material 62, the slits 52 are not formed by punching or piercing clear through the upper wall of the spacer, but are instead formed by shearing or splitting the material along the edges of the slits and moving it apart so as to create an air gap which is sufficient to interrupt conduction of thermal energy across the slit, but without creating an opening which is large enough to permit passage of the granules/particulate desiccant material therethrough.

Figure 3:
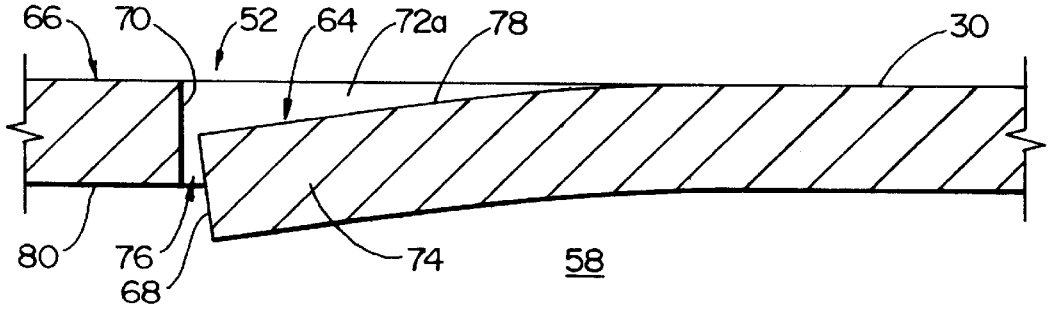
FIG. 3 is an enlarged, cross-sectional view of one of the slits formed in the upper surface of the spacer of FIG. 2, showing the configuration of the material of the spacer in the areas adjacent the slit in greater detail.
Figure 4:
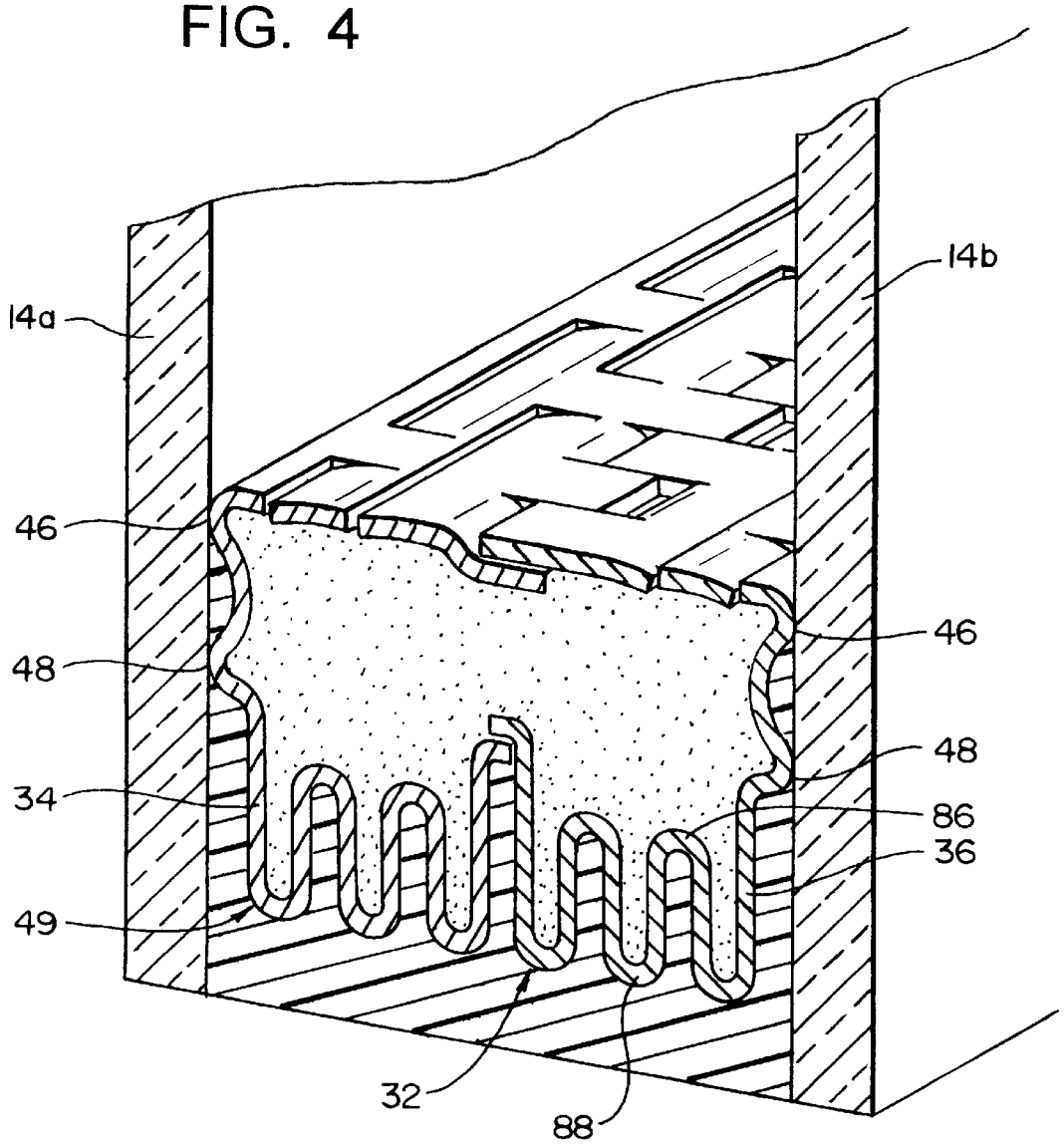
FIG. 4 is a cross-sectional view of a second preferred embodiment of a spacer frame bar positioned between two glass panes.

Accordingly, as can be seen more clearly in FIG. 3, each slit 52 is preferably formed by displacing (e.g., depressing) a first portion 64 of the metal panel 30 relative to a second, adjacent portion 66, thereby breaking/shearing the metal and separating this along the edges 68, 70 of the longitudinal slit. During formation of the slit, the metal also breaks or "tears" back at the ends of the slit, along first and second transverse edges 72*a,* 72*b.* As a result the displaced portion 54 is bordered by breaks/openings along three sides, thereby forming essentially a shallowly bent tab portion 74.

As can be seen, each tab portion 74 is bent sufficiently far relative to the remainder of panel 30 that an air gap 76 is opened between the longitudinal edges 68, 70 of the slit, but preferably not so far that the upper surface 78 of the metal is depressed past its the lower surface 80. In other words, the end of the tab portion 74 is bent inwardly by a distance which is preferably no more than the overall thickness of the material forming the upper panel of the spacer; for example, when using 3000–5000 series aluminum alloys having a thickness of about 0.005"–0.020", depressing the end of the tab portion by a distance equal to about 30%–90% of the thickness of the metal has been found suitable for many embodiments when of the invention.

As a result, the sheared edges 68, 70 of the completed slit converge inwardly towards the air gap 76 as viewed from the interior 58 of the spacer. This constricts the opening so as to obstruct and minimize admission of the dessicant material to air gap 76. Moreover, the width "w" of the air gap itself is preferably sized close to or smaller than the diameter of the dessicant particles, so as to virtually eliminate any possibility that the material will be able to pass therethrough.

The slits 52 are preferably formed using a rotating cutter wheel, which allows the slits to be formed continuously during roll-forming of the spacer, rather than having to stop or otherwise hold the material stationary for punching or stamping. Moreover, unlike a very narrow slot punched vertically through the metal, the "tear back" edges 72*a,* 72*b* of each tab portion 74 extend back to proximate the next row of slits, essentially forming a right-angle extension of the thermal break at each end of the slit. This maximizes the length of the thermal conductivity paths, as indicated by arrow 82 in FIG. 2, rather than the heat being allowed to follow a diagonal path directly from the end of one slot to the next.

It will be understood that some of these advantages will be available in instances where the metal is bent or displaced by an amount which is actually greater than the thickness of the material, and that, while not generally preferred, this also falls within the scope of the present invention.

Referring now to FIG. 2, the first and second sidewalls 34 and 36 are configured from the base of the second contact line 48 to the lower arcuate corner 49, defined by the intersection of the sidewall and the lower surface 32, to be described in greater detail hereafter. A sealant 60, preferably an elastomer or mastic-like material, extends about the outer periphery of the insulated glass panel 10 and is formed into the recesses 50 of the first and second halves 38 and 40, as well as into other spaces between the sidewalls 34 and 36 and the glass panes 14*a* and 14*b*. The sealant 60 assures that the glass panes 14*a* and 14*b* are hermetically bonded to the frame 12.

In the first preferred embodiment of the invention illustrated in FIG. 2, the lower half of the first and second sidewalls 34 and 36 is also corrugated. When viewed along the longitudinal axis of the frame 12, both the first and second sidewalls 34 and 36 define a plurality of spaced folds 84, layered between the upper and lower surfaces 30 and 32. The folds 84 are defined in the sidewalls 34 and 36 from below the second contact line 48 to the lower corner 49 such that the folds 84 define parallel and alternating indentations 36 and protrusions 88. From immediately below the second contact line 48, the sidewall 34 curves away from the glass pane 14*a,* defining a path that is substantially normal to the plane defined by the glass pane 14*a.* The path of the sidewall 34 continues away from the glass pane 14*a* for a predetermined distance where it curves at a predetermined radius of curvature 180 degrees back toward the glass pane 14, thereby defining an indentation 66 within the concave portion of the sidewall 34. The sidewall 34 continues toward the glass pane 14*a* for a predetermined distance before again curving at a predetermined radius of curvature 180 degrees away from the glass pane 14*a,* whereby the convex portion of the sidewall 34 defines a protrusion 88. The corrugation process is repeated such that a plurality of indentations 86 and protrusions 88 are defined for both halves 38 and 40 of the frame 12. Furthermore, both sidewalls 34 and 36 are corrugated such that the protrusions 88 do not contact the glass panes 14*a* and 14*b,* thereby defining a void 90 therebetween. The corrugated portion lengthens the thermal migration path through the first and second sides 24 and 25 by providing additional material through which heat energy must travel before reaching the opposing glass pane. The sinuous thermal migration path defined through the corrugations is significantly longer than the width o the frame 12.

A particular advantage of the corrugations being formed in the sidewalls 34, 36, as opposed to a vertical, "W" pattern having the corrugations formed in the bottom wall of the spacer, is that the spacer is somewhat easier to bend at the corners of the window or other panel. Furthermore, the spacer having this configuration has increased stiffness in the lateral direction, and is less likely to "accordion" under inward and outward pressures exerted by or via the glass panes.

Although FIG. 2 illustrates a pair of indentations 86 and protrusions 88, fewer or more in number are within the scope of the invention. Furthermore, even though corrugating both sidewalls 34 and 36 of the frame 12 is the preferred embodiment, additional configurations of the corrugations are also within the scope of the invention. As nonlimiting examples, the plurality of folds 86 may be formed by corrugating only the first or second sidewall 34 and 36, or the upper or lower surface 30 and 32, as seen in FIG. 3.

FIG. 3 illustrates a second preferred embodiment of the frame bar 12 constructed in accordance with the present invention. The frame 12 of this embodiment is identical to that of the first preferred embodiment except for the orientation of the corrugated portion. As seen in FIG. 3, the folds 64 are defined by the lower surface 32 instead of by the first and second sidewalls 34 and 36. When viewed along the longitudinal axis, the folds 84 are formed in the lower surface 32 between the lower corner 49 and the second seam defined by the overlapping intersection of the first and second halves 38 and 40. The folds 84 are defined by the corrugation process described above, except that the surface is folded in a direction that is parallel to a plane defined by the glass panes 14*a* and 1*b,* instead of perpendicular thereto as described in the first preferred embodiment. Thus, the alternating indentations and protrusions 86 and 88 of the second preferred embodiment are layered between the first and second sidewalls 34 and 36.

The sidewalls 34 and 36 remain oriented as previously described such that contact between the frame 12 and the glass panes 14*a* and 14*b* is limited to the first and second contact lines 46 and 48. Thus, limiting contact between the frame 12 and the glass panes 14*a* and 14*b* to the contact lines 46 and 48 also limits conductive heat transfer therebetween. Although corrugating the lower surface 32 of the frame 12 is the second preferred embodiment, the corrugation of additional surfaces, such s corrugating both the upper and lower surfaces 30 and 32, or corrugating just the upper surface 30, is also within the scope of the invention.

The lengthening of the thermal migration path between the glass panes 14*a,* 14*b* across the frame 12 may be best understood by referring back to FIG. 2. As is well known in the art, a temperature difference between two heat sources will cause heat energy to migrate from a higher temperature heat source to a lower temperature heat source. Thus, any temperature difference between the glass panes will cause heat energy to migrate therebetween. Furthermore, because the frame 12 may be manufactured from materials having high thermal conductivity, such as steel or aluminum, heat energy will travel through the frame 12 whenever there is a temperature difference between the glass panes 14*a* and 14*b*. As seen in FIG. 2, the path of heat energy migrating across the upper surface 30 is interrupted and increased because it must bypass a first set of first and second rows 54, 56 of slits 52, then through the thermally broken seam 42, and then through a second set of first and second rows 54, 52 of slits 52.

Still referring to FIG. 2, the corrugated portion of he first and second sidewalls 34 and 36 also lengthens the thermal migration path through the frame 12 across the lower surface 32. In order for heat energy to migrate through the corrugated portion of the frame 12, it must travel through additional lengths of the material added by the indentations 66 and the protrusions 68 of the corrugated portion. Thus, corrugating the first and second sidewalls 34 and 36 physically extends the path through which heat energy must travel between the glass panes 14*a* and 14*b* and, therefore, inhibits heat transfer therethrough.

The previously described versions of the present invention have the advantage of significantly reducing the energy loss between two glass panes connected by a spacer frame. The slits 52 increase the thermal migration path across the upper surface 30 by preventing a direct migration path between two glass panes 14*a* and 14*b*. Corrugating the sides of the frame 12 also increases the path of conductive thermal migration between the glass panes 14*a* and 14*b*. Corrugating the first and second sidewalls 34 and 36 of the frame 12 physically lengthens the frame 12 and, therefore, increases the conductive thermal migration path between the glass panes 14*a* and 14*b*.

While the preferred embodiment of the invention has been illustrated and described, it will be appreciated that various changes can be made therein without departing from the spirit and scope of the invention.

What is claimed is:

1. An elongate tubular spacer frame bar used to space first and second glass panes, said spacer frame bar comprising:

an elongate tubular spacer member having first and second longitudinal sidewalls for engaging first and second glass panes in spaced relationship, and upper and lower longitudinal walls each spanning from said first sidewall to said second sidewall and defining a spacer width between said first and second sidewalls;

said first and second sidewalls and upper and lower walls defining an interior space of said bar for holding a particulate desiccant material therein;

said upper wall comprising first and second spaced sequences of longitudinally oriented elongate slits defined in said upper wall so as to create a thermal energy conductive path across said upper wall from said first sidewall to said second sidewall which is greater in length than said spacer width between said sidewalls; each said elongate slit being defined by a first portion of said upper wall along a first edge of said slit which is displaced relative to a second portion of said upper wall along a second, opposite edge of said slit, by an amount which is sufficiently great to open an air gap between said edges of said slit, but which is sufficiently small to avoid creating an opening wide enough to permit unobstructed passage of said particulate desiccant material therethrough.

2. The spacer frame bar of claim 1, wherein said upper wall of said bar comprises a substantially planar member having upper and lower surfaces and a vertical thickness and wherein said first portion of said top wall is displaced vertically relative to said second portion by an amount which is less than said vertical thickness of said upper wall of said spacer.

3. The spacer frame bar of claim 2, wherein said upper wall of said bar comprises an aluminum alloy member having a thickness in the range from about 0.005" to about 0.020".

4. The spacer frame bar of claim 3, wherein said particulate desiccant material has a predetermined average diameter.

5. The spacer frame bar of claim 4, wherein said first portion of said top wall is displaced relative to said second portion by a distance which is equal to about 30% to about 95% of said thickness of said upper wall of said spacer, so as to form an air gap having a width equal to or less than said predetermined average diameter of said particulate desiccant material.

6. The spacer frame bar of claim 2, wherein said first portion of said upper wall is displaced vertically downwardly relative to said second portion of said wall.

7. The spacer frame bar of claim 1, wherein said upper wall of said spacer is formed of a malleable metal sheet material.

8. The spacer frame bar of claim 7, wherein said first portion of said upper wall is displaced relative to said second portion by an amount which is sufficient to form first and second breaks in said metal material which extend laterally from first and second ends of said slit so as to interrupt conduction of thermal energy across said breaks.

9. The spacer frame bar of claim 8, wherein said breaks at said ends of said slit extend laterally from said first sequence of longitudinally oriented slits towards said second sequence of slits.

10. The spacer frame bar of claim 9, wherein said breaks extend by a distance which is greater than one-half of a lateral distance from said first sequence of longitudinally oriented slits to said second sequence of slits.

11. The spacer frame bar of claim 1, wherein said first and second sidewalls each comprise:

at least one contact line for engaging one of said first and second glass panes.

12. The spacer frame bar of claim 11, wherein each said sidewall further comprises:

a plurality of elongate folds formed in said sidewall intermediate said contact line and a lower edge at which said lower wall joins said sidewall, so as to create a thermal energy conductive path across said sidewall from said contact line to said lower wall of said spacer member which is greater in length than a straight line path from said contact line to said lower edge of said sidewall.

13. The spacer frame bar of claim 1, wherein said lower wall of said spacer member comprises:

a plurality of elongate folds formed in said lower wall so as to create a thermal energy conductive path across said lower wall from said first sidewall to said second sidewall which is greater in length than said spacer width between said sidewalls.

14. A method for creating a lengthened thermal energy conductive path in an elongate tubular spacer frame bar used to space first and second glass panes, said method comprising the steps of:

providing an elongate tubular spacer member having an interior space for holding a particulate desiccant material therein and a wall portion which defines a spacer width between first and second glass panes; and forming first and second spaced sequences of longitudinally oriented elongate slits in said wall portion of said spacer member so as to create a thermal energy conductive path across said wall portion from said first pane to said second pane which is greater in length than said spacer width which is defined by said wall portion;

each said elongate slit being defined by a first portion of said wall portion along a first edge of said slit which is permanently displaced relative to a second portion of said wall portion along a second opposite edge of said slit by an amount which is sufficiently great to open an air gap between said edges of said slit, but which is sufficiently small to avoid creating an opening wide enough to permit substantially unobstructed passage of said particulate desiccant material therethrough.

15. The method of claim 14, wherein said wall portion of said spacer member comprises a substantially planar member having upper and lower surfaces and a vertical thickness and wherein the step of forming said slits therein comprises:

displacing said first portion of said wall portion along said first edge of each slit vertically relative to said second portion on said opposite side of said slit by an amount which is less than said vertical thickness of said wall portion of said spacer member.

16. The method of claim 15, wherein the step of displacing said first portion of said wall portion relative to said second portion on said opposite side of said slit comprises:

displacing said first portion of said wall portion vertically downwardly relative to said second portion of said wall portion.

17. The method of claim 14, wherein the step of providing said elongate tubular spacer member comprises:

forming said wall portion of said spacer member of a malleable metal sheet material.

18. The method of claim 17, wherein the step of forming said slits in said wall portion of said spacer member comprises:

displacing said first portion of said wall portion relative to said second portion by an amount which is sufficient to form first and second breaks in said metal material which extend laterally from first and second ends of each said slit so as to interrupt conduction of thermal energy across said breaks.

19. The method of claim 18, wherein the step of forming said slits in said wall portion of said spacer member further comprises:

forming said breaks at said ends of each said slit so that said breaks extend laterally from said first sequence of longitudinally oriented slits towards said second sequence of slits.

20. The method of claim 19, wherein the step of forming said breaks at said ends of each said slit comprises:

forming said breaks so that said breaks extend by a distance which is greater than one-half of a lateral distance from said first sequence of longitudinally oriented slits to said second sequence of slits.

* * * * *